United States Patent [19]

Finlay et al.

[11] 3,961,735

[45] June 8, 1976

[54] SEAL

[75] Inventors: Alexander James Finlay; Geoffrey Taylor, both of Manchester, England

[73] Assignee: Imperial Chemical Industries Limited, London, England

[22] Filed: Sept. 9, 1974

[21] Appl. No.: 504,264

[30] Foreign Application Priority Data

Oct. 4, 1973 United Kingdom ..... 46377/73

[52] U.S. Cl. ..... 226/168; 226/197

[51] Int. Cl.[2] ..... B65H 17/24

[58] Field of Search ..... 226/7, 95, 97, 197, 226/168

[56] References Cited

UNITED STATES PATENTS

| | | | |
|---|---|---|---|
| 3,061,159 | 10/1962 | Jacobsen | 226/97 X |
| 3,245,334 | 4/1966 | Long | 226/97 X |
| 3,626,603 | 12/1971 | Breyer | 226/97 X |

*Primary Examiner*—Richard A. Schacher
*Attorney, Agent, or Firm*—Cushman, Darby & Cushman

[57] ABSTRACT

A sealing means for permitting continuous passage of a web material through a gap in a wall separating two zones at different pressures whilst minimising the flow of air from one zone to the other, comprising a cylindrical rod passing through the gap, means for feeding the web material on to the rod in helical disposition on one side of the wall, means for removing the web material from the rod after the web material has passed through the gap to the other side of the wall, and sealing means fitted to the circumference of the gap so as to contact the web material as it passes through the gap, and the use of two such sealing means as an entrance to, and exit from, an apparatus the interior of which is to be maintained at a pressure less than atmospheric pressure, and in which apparatus the web material is to be given an appropriate treatment.

4 Claims, 1 Drawing Figure

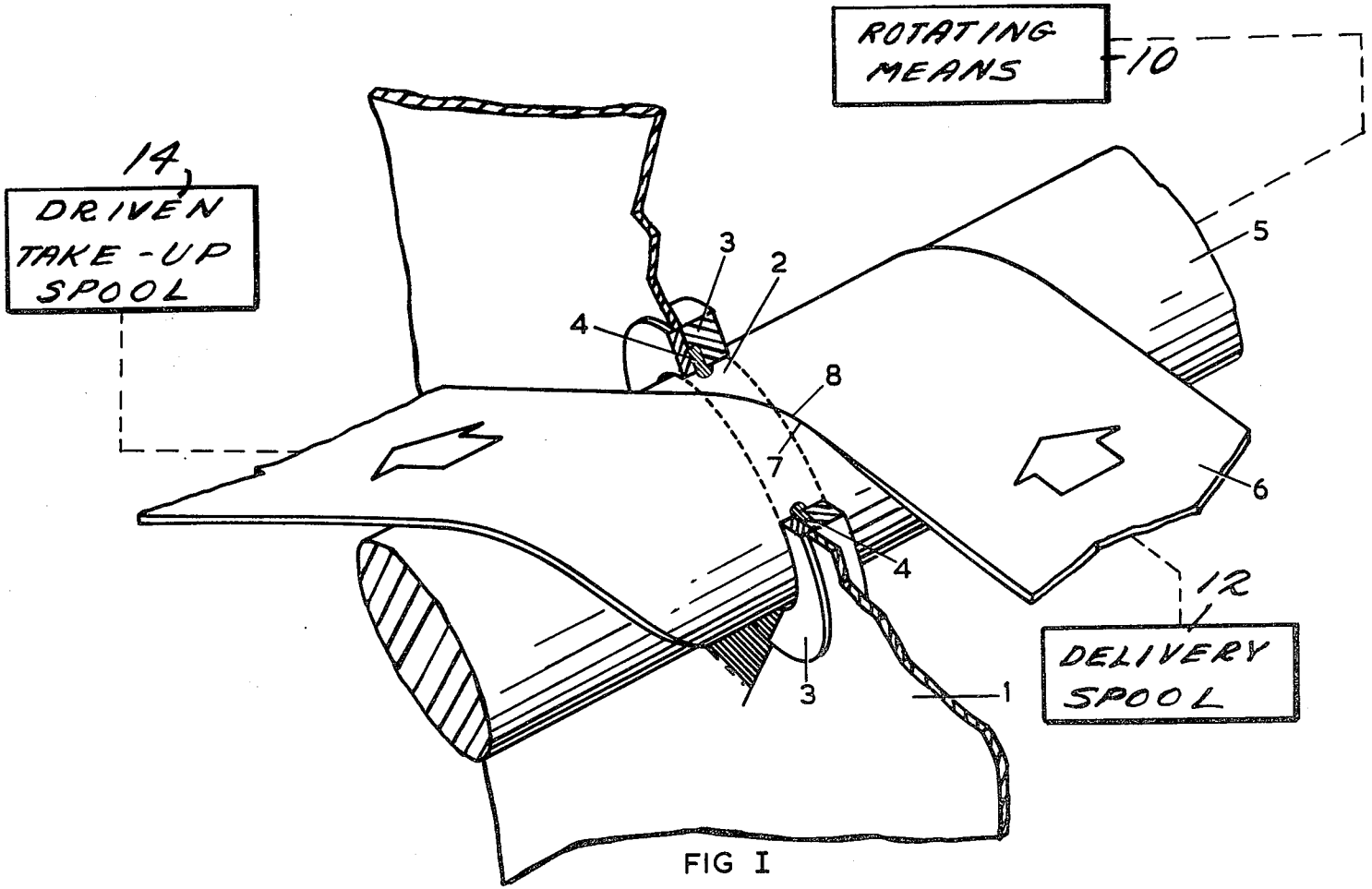
FIG I

SEAL

This invention relates to an improved seal which enables a textile material to be transferred across a pressure differential whilst minimising the flow of air through the seal.

In the process of vacuum transfer colour printing, a transfer paper which has been printed with one or more disperse dyestuffs is placed with its printed surface in contact with a synthetic textile material in an enclosed chamber which is then evacuated and the paper and material then heated whilst in contact to a temperature which is usually in the region of from 160°C to 220°C. The chamber is preferably evacuated to a vacuum of at least 25 inches (635 mms.) of mercury, and above all to a vacuum in the region of 27 to 30 inches (685 to 760 mms.) of mercury. When the process is carried out in an intermittent manner a press is used in which the enclosed chamber comprises the space between two platens which is bounded by a sealing strip, the said space being connected to a suitable source of vacuum, and in this type of apparatus there is no difficulty in readily achieving the required amount of vacuum. However in order to carry out the process in a continuous manner it is necessary for the transfer paper and the textile material to be passed over a heated surface inside a vacuum chamber. Whilst the rolls of transfer paper and the textile material, both before and after the heat treatment, can be stored within the vacuum chamber, provision of such storage space markedly increases the size of the chamber thus resulting in increased loads on the chamber due to atmospheric pressure. Further the process has to be interrupted in order to remove the rolls of treated textile material and used transfer paper and to insert new rolls of transfer paper and/or textile material. These difficulties could be overcome by passing the textile material and the transfer paper through a vacuum chamber containing therein the heated surface, the textile material and the transfer paper entering and leaving the chamber through seals which would minimise the entry of air into the evacuated chamber. Whilst the entry of a small amount of air into the evacuated chamber can be dealt with by means of a suitable source of vacuum, thus enabling the required degree of vacuum to be maintained within the chamber, sealing systems currently available allow too much air to be admitted into the evacuated chamber so that in practice the required degree of vacuum cannot be maintained. The present invention is directed to improved sealing systems which whilst freely allowing the passage of the textile material and/or the transfer paper through the seal minimise the flow of air through the seal.

According to the invention there is provided a sealing means for permitting continuous passage of a web material through a gap in a wall separating two zones at different pressures whilst minimising the flow of air from one zone to the other, comprising a cylindrical rod passing through the gap, means for feeding the web material on to the rod in helical disposition on one side of the wall, means for removing the web material from the rod after the web material has passed through the gap to the other side of the wall, and sealing means fitted to the circumference of the gap so as to contact the web material as it passes through the gap.

The gap in the wall can be in the form of an oval, in which case the cylindrical rod passes through the gap at such an angle that its cross-section at that point is of the same shape, but slightly smaller in size, than the gap in the wall. It is however preferred that the gap is circular in which case the cylindrical rod passes through the gap at right angles to the wall.

Whilst the wall is generally constructed of plate, the material of which and the thickness thereof corresponds to the difference in pressures across the wall, it is preferred that the edge of the gap is built up so as to more readily accomodate the sealing means which can be, for example, a continuous O-ring seal of a compressible material such as a silicon rubber which is attached to the inside edge of the gap.

In utilising the seal, the web material, in the form of a continuous length, is fed on to the cylindrical rod so that the web material takes up a helical disposition on the cylindrical rod with the adjacent edges of the web material in contact with each other, so that at the point where the web material passes through the gap, the cylindrical rod is completely covered by a single layer of web material. The web material being firmly held in contact with the cylindrical rod at this point by the pressure exerted on it by the seal surrounding the gap. The leading end of the web material is then attached to a take-up spool which is connected to a source of power so that the web material is gradually drawn through the seal before being wound on to the take-up spool. After the web material passes through the seal it unwinds itself off the cylindrical rod before arriving at the take-up spool. After the web material has unwound itself off the cylindrical rod it can be subjected to a treatment, such as a heat treatment, before it is wound on to the take-up spool. Before the web material is continuously passed through the seal the pressure on one side of the seal is reduced, for example by means of a vacuum pump, or increased, for example by means of compressed air, such pressure differential preferably being maintained during passage of all the web material through the seal.

During passage of the web material through the seal, the cylindrical rod can be rotated, the direction of rotation being compatible with the feed direction of the web material on the cylindrical rod.

Preferably two such seals are used in each apparatus, one of the seals being used as an entrance to the apparatus and the other as an exit, and the interior of the apparatus being maintained at a pressure less than atmospheric pressure whilst the exterior of the apparatus is maintained at atmospheric pressure. In this case the web material is unwound from the first rod after entering the apparatus, the web material is given an appropriate treatment within the apparatus, and then passes through the second seal in a similar manner to that of the first seal where, as it is unwound from the cylindrical rod of the second seal it is taken up by a driven take-up spool.

By way of illustration, an apparatus which is a preferred embodiment of the invention will now be described with reference to FIG. I of the accompanying drawings which represents a perspective view of the seal having part of the wall cut away so as to show both sides of the seal.

In FIG. I, the wall is represented by 1 and contains a circular gap 2, the edge of which carries a circular reinforcement 3 the internal edge of which carries a continuous O-ring seal 4. Mounted on bearings, not shown, and passing through the gap 2 is a cylindrical rod 5 which is connected to a rotating means 10 so that it rotates in the direction indicated by the arrows. Delivery and take-up spools 12 and 14 respectively are also provided for the web material which is fed onto the cylindrical rod 5 in a helical disposition so that adjacent edges 7 and 8 of the web material 6 are in contact round the cylindrical rod 5 at the point where it actually passes through the gap 2 in the wall 1. The diameter of the cylindrical rod 5 being such that the O-ring seal 4 is in contact with the web material 6 and maintains the web material in contact with the cylindrical rod.

In operating this particular seal, the cylindrical rod 5 is rotated, the web material 6 is fed on to the cylindrical rod so that the web material takes up a helical disposition and its adjacent edges are in contact, and, after passing through the gap, the web material is unwound from the cylindrical rod on to a take-up spool or passed through the apparatus before emerging from the apparatus through a similar type of seal.

In order that the web material can be satisfactorily wound on to the cylindrical rod in a helical disposition the diameter of the cylindrical rod must not be too small relative to the width of the web material otherwise the angle of the web material relative to the longitudinal axis of the cylindrical rod becomes too small. The relationship can be expressed by the formula $$D = (W/\pi) \operatorname{cosec} (90-\alpha)$$

wherein $D$ is the diameter of the cylindrical rod, $W$ is the width of the web material, and $\alpha$ is angle between the edge of the web material and the longitudinal axis of the cylindrical rod.

Thus, if $\alpha$ is 45°, the diameter of the cylindrical rod is approximately 0.45 times the width of the web material.

In order to facilitate feeding of the web material on to the cylindrical rod, the cylindrical rod can be marked with lines or contain grooves in a helical disposition which correspond to the angle at which the web material is to be fed on to the cylindrical rod. However any such lines or grooves should not abut on to that portion of the cylindrical rod which is in the actual gap in the wall otherwise there could be a consequential flow of air through the seal.

In order to reduce frictional forces between the underside of the web material and the surface of the cylindrical rod, particularly when the cylindrical rod is not rotated, one or more rollers can be set into the cylindrical rod so that the outer edge of each of the said rollers just protrudes above the surface of the cylindrical rod, the positioning of each of the rollers being such that each assists the passage of the web material over the surface of the cylindrical rod.

It will be understood that details of the apparatus which has been described may be varied without departing from the essential characteristics of the invention, nor have details been given of the necessary ancilliary equipment such as the take-up and delivery spools for the web material or the power source for the cylindrical rod.

Although the said seal has been particularly described with reference to its use in an apparatus for carrying out the vacuum transfer colour printing of textile materials, the seal can also be used in any other apparatus in which it is desired to transfer a textile material or in fact any material in the form of webs or films across a pressure differential boundary without a substantial flow of air or other gas through the seal.

We claim:

1. A sealing means for permitting continuous passage of a web material through a gap in a wall separating two zones at different pressures while minimising the flow of air from one zone to the other, comprising a cylindrical rod passing through the gap, means for feeding the web material on to the rod in helical disposition on one side of the wall, means for removing the web material from the rod after the web material has passed through the gap to the other side of the wall, and sealing means fitted to the circumference of the gap so as to contact the web material as it passes through the gap.

2. A sealing means as claimed in claim 1 wherein the gap is circular and the cylindrical rod passes through the gap at right angles to the wall.

3. A sealing means as claimed in claim 1 wherein means are additionally provided for rotating the cylindrical rod in a direction which is compatible with the feed direction of the web material.

4. A sealing means as claimed in claim 1 wherein the diameter of the cylindrical rod is governed by the formula:

$$D = (W/\pi) \operatorname{cosec} (90-\alpha)$$

wherein $D$ is the diameter of the cylindrical rod, $W$ is the width of the web material, and $\alpha$ is the angle between the edge of the web material and the longitudinal axis of the cylindrical rod.

* * * * *